US010333253B2

(12) United States Patent
Zhao

(10) Patent No.: US 10,333,253 B2
(45) Date of Patent: Jun. 25, 2019

(54) ELECTRICAL CONNECTOR WITH REINFORCED AND THICKENED METALLIC SHIELDING PLATE ON FRONT EDGE OF MATING TONGUE

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/870,873

(22) Filed: Jan. 13, 2018

(65) Prior Publication Data

US 2018/0205180 A1 Jul. 19, 2018

(30) Foreign Application Priority Data

Jan. 14, 2017 (CN) ..... 2017 1 0026643

(51) Int. Cl.

| | |
|---|---|
| ***H01R 13/6582*** | (2011.01) |
| ***H01R 13/405*** | (2006.01) |
| ***H01R 43/24*** | (2006.01) |
| ***H01R 13/504*** | (2006.01) |
| ***H01R 13/506*** | (2006.01) |
| ***H01R 13/6585*** | (2011.01) |
| ***H01R 13/66*** | (2006.01) |
| *H01R 24/60* | (2011.01) |

(Continued)

(52) U.S. Cl.

CPC ..... *H01R 13/6582* (2013.01); *H01R 13/405* (2013.01); *H01R 13/504* (2013.01); *H01R 13/506* (2013.01); *H01R 13/6585* (2013.01); *H01R 13/6658* (2013.01); *H01R 43/24* (2013.01); *H01R 12/71* (2013.01); *H01R 24/60* (2013.01); *H01R 2107/00* (2013.01)

(58) Field of Classification Search

CPC ..... H01R 13/504; H01R 13/506; H01R 13/6582; H01R 13/405; H01R 13/6585

See application file for complete search history.

(56) References Cited

U.S. PATENT DOCUMENTS 6,269,539 B1 * 8/2001 Takahashi ..... H01R 13/641 29/856
9,979,102 B2 * 5/2018 Zhao ..... H01R 9/032

(Continued)

FOREIGN PATENT DOCUMENTS

| | | |
|---|---|---|
| CN | 204947243 U | 1/2016 |
| CN | 206211123 U | 5/2017 |
| TW | M519829 U | 4/2016 |

*Primary Examiner* — Briggitte R. Hammond
(74) *Attorney, Agent, or Firm* — Wei Te Chung; Ming Chieh Chang

(57) ABSTRACT

An electrical connector includes a metallic frame, an insulative housing and two rows of contacts. The metallic frame made by metal injection molding and includes a main part and a first plat section. Two rows of contacts are respectively located by two sides of the first plate section in the vertical direction. The housing is secured to both the contacts and the frame and forms a mating tongue enclosing the first plate section. Thickened portions are formed on a front edge and two opposite side edges of the first plate section, and exposed upon a front edge and two opposite side edges of the mating tongue.

20 Claims, 5 Drawing Sheets

(51) Int. Cl.
*H01R 107/00* (2006.01)
*H01R 12/71* (2011.01)

(56) References Cited

U.S. PATENT DOCUMENTS

2015/0093936 A1* 4/2015 Little ..... H01R 13/6583
439/607.19
2015/0295362 A1* 10/2015 Tziviskos ..... H01R 13/6581
439/607.01
2016/0141806 A1* 5/2016 Guo ..... H01R 13/504
439/607.01
2017/0018883 A1* 1/2017 Chen ..... H01R 24/62
2017/0222372 A1* 8/2017 Wang ..... H01R 13/6591

* cited by examiner

ELECTRICAL CONNECTOR WITH REINFORCED AND THICKENED METALLIC SHIELDING PLATE ON FRONT EDGE OF MATING TONGUE

1. FIELD OF THE DISCLOSURE

The invention is related to an electrical connector, and particularly to an electrical connector with a reinforced and thickened metallic shielding plate on the front edge of the mating tongue.

2. DESCRIPTION OF RELATED ARTS

U.S. Pat. No. 9,496,653 discloses the USB (Universal Serial Bus) Type C receptacle connector wherein a metallic shielding plate is embedded within a mating tongue of the housing for shielding and reinforcing and locking. Anyhow, because the dimension of the mating tongue of the connector is relatively tiny, the strength thereof is relatively insufficient during heavy operation.

Therefore, it is desired to have an electrical connector equipped with a reinforced and thickened shielding plate, and particularly on the front edge of the mating tongue.

SUMMARY OF THE DISCLOSURE

To achieve the aforementioned object, an electrical connector includes a metallic frame, an insulative housing and two rows of contacts. The metallic frame made by metal injection molding and includes a main part and a first plat section. Two rows of contacts are respectively located by two sides of the first plate section in the vertical direction. The housing is secured to both the contacts and the frame and forms a mating tongue enclosing the first plate section. Thickened portions are formed on a front edge and two opposite side edges of the first plate section, and exposed upon a front edge and two opposite side edges of the mating tongue.

DETAILED DESCRIPTION OF THE PREFERRED EMBODIMENT

Figure 1:
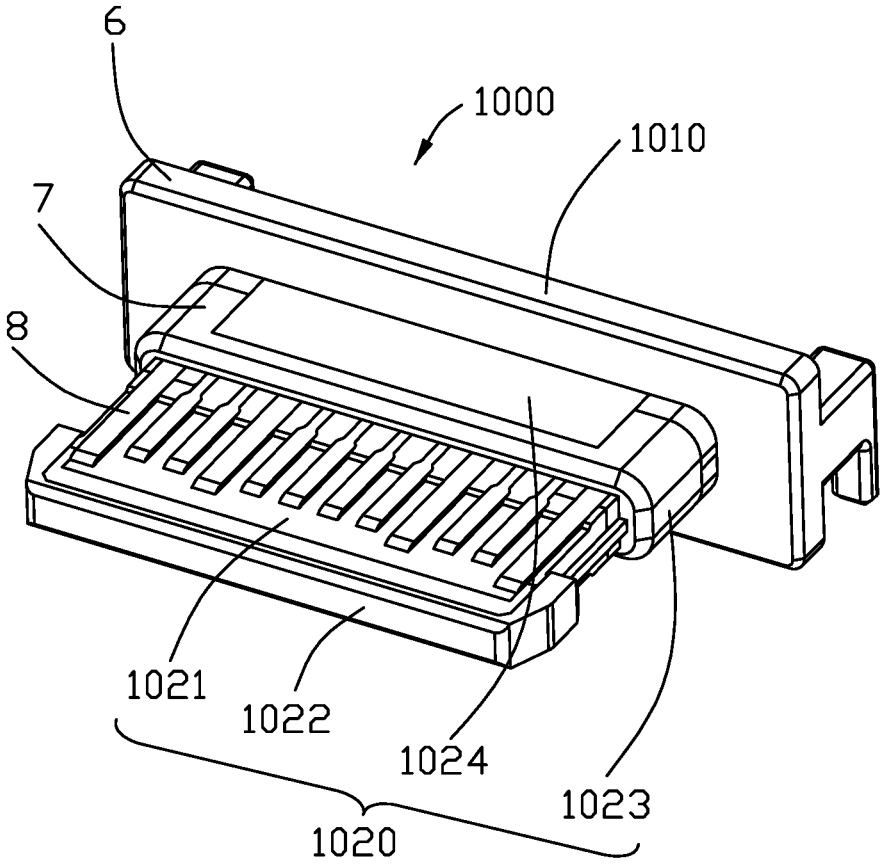
FIG. 1 is a perspective view of the electrical connector according to the invention.
Figure 2:
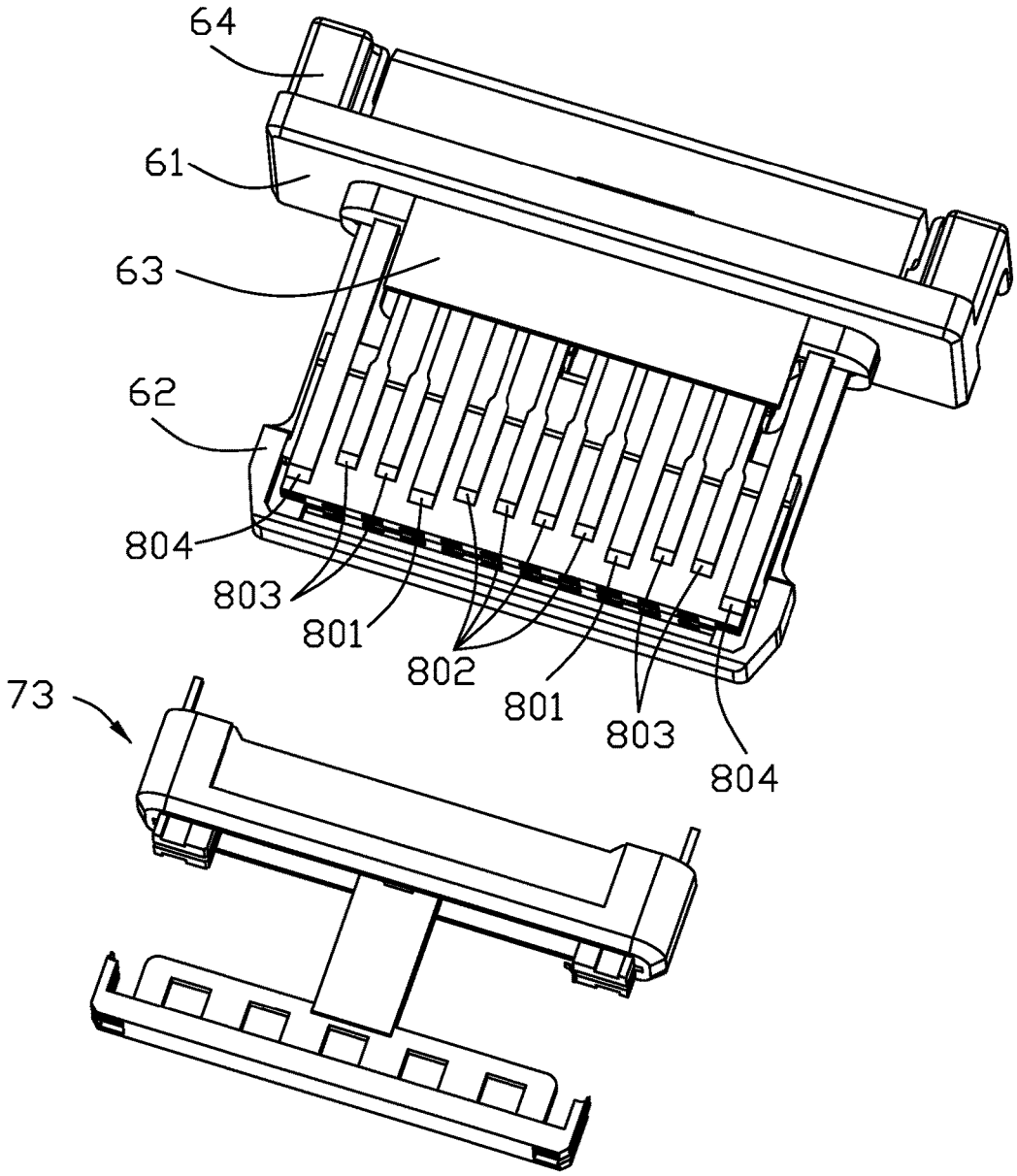
FIG. 2 is an exploded perspective view of the electrical connector of FIG. 1 wherein the insulator is separated from the remainders of the electrical connector of FIG. 1.
Figure 3:
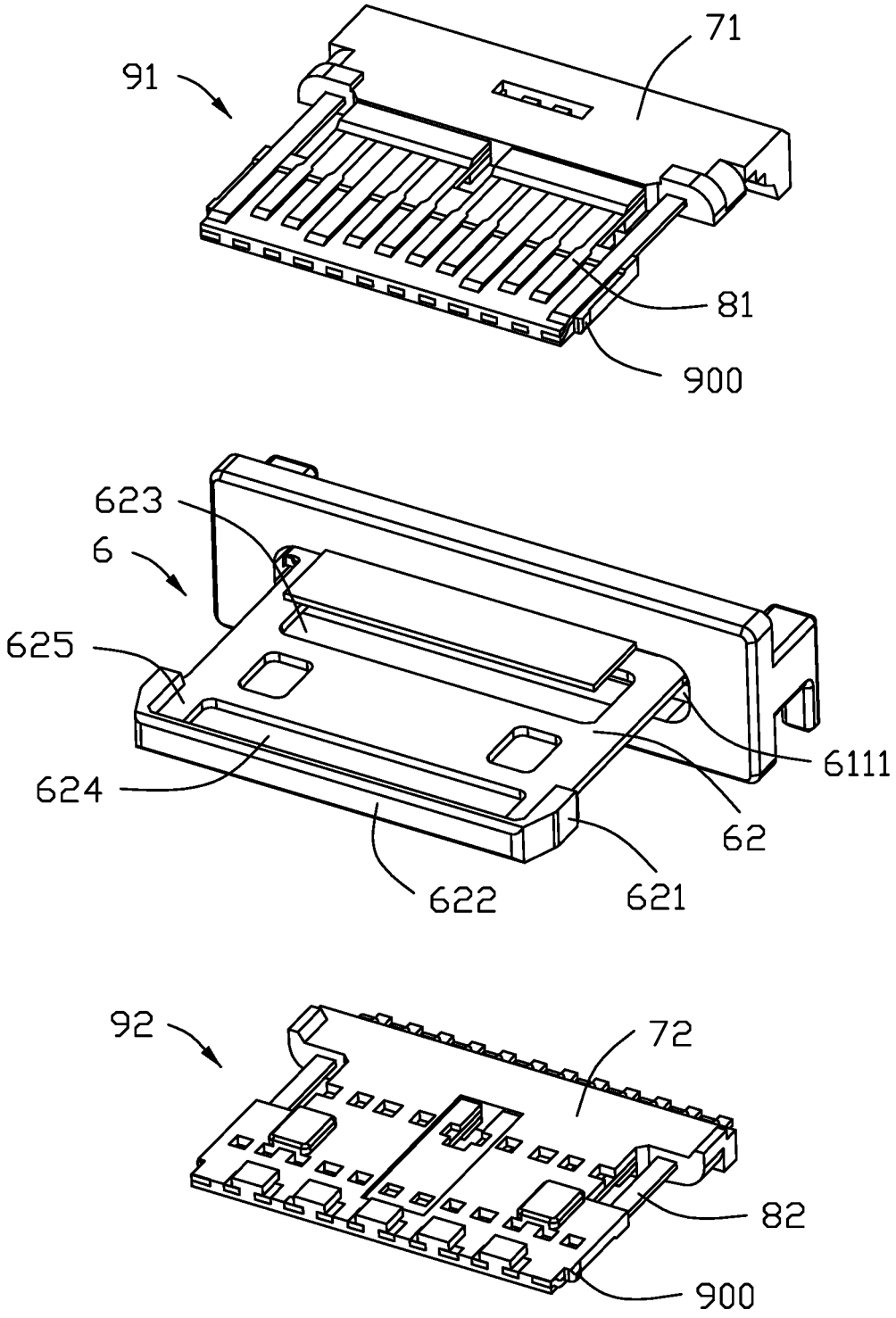
FIG. 3 is a further exploded perspective view of the electrical connector of FIG. 2 wherein the upper contact module and the lower contact module are separated from the frame.
Figure 4:
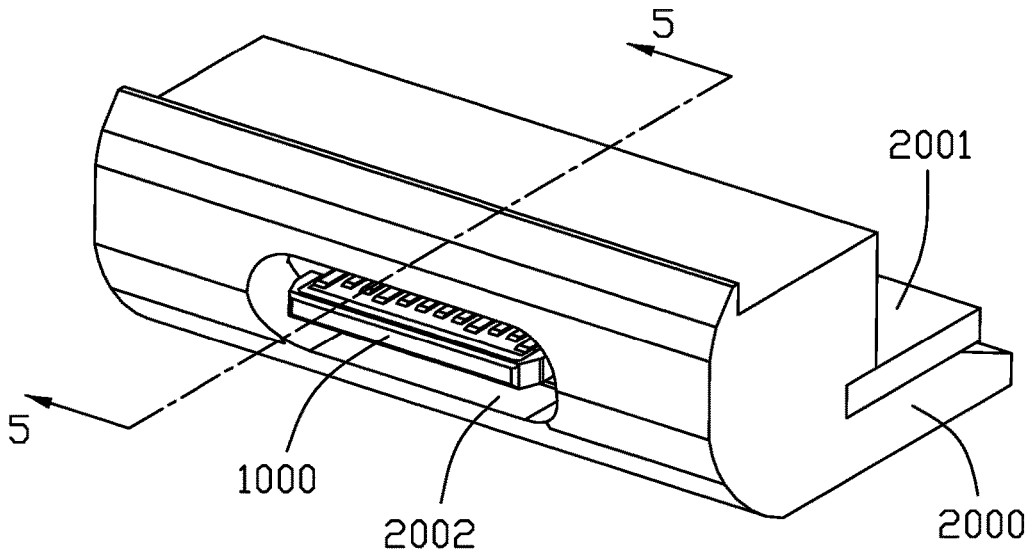
FIG. 4 is a perspective view of the electrical assembly to enclose the electrical connector of FIG. 1.
Figure 5:
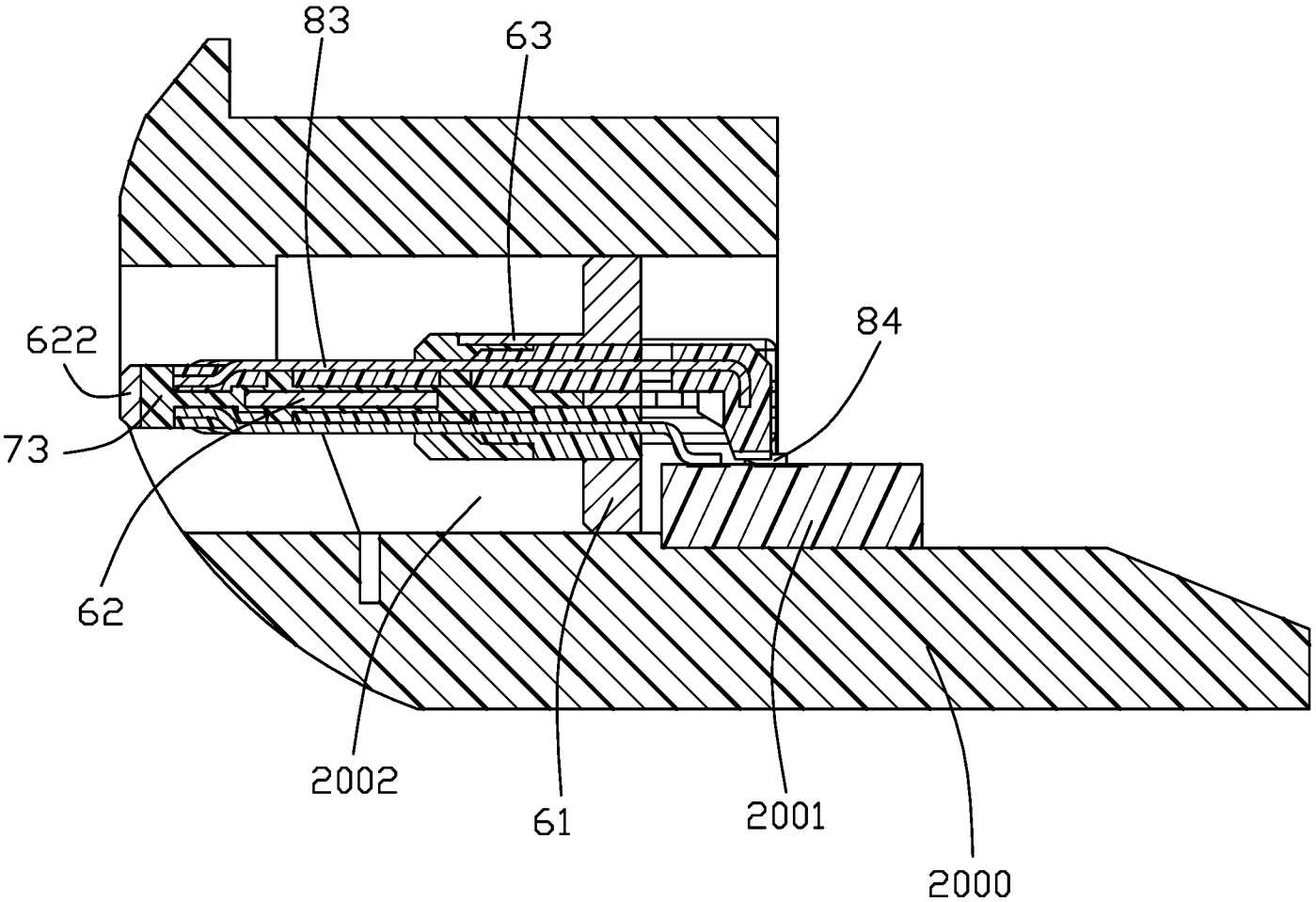
FIG. 5 is a cross-sectional view of the electrical assembly of FIG. 4

Reference will now be made in detail to the embodiments of the present disclosure. Referring to FIGS. 1-5, an electrical connector 1000 for mating with a USB Type C plug/cable connector, includes an insulative housing 7 with a vertical base 1010 and a horizontal mating tongue 1020 extending forwardly from the housing 1010. The mating tongue 1020 forms opposite mating surfaces 1021, a front face 1022, two side faces 1023, and a step section 1024 adjacent to the base 1010.

Tow rows of contacts 8 include the upper/first contacts 81 and the lower/second contacts 82. The upper contacts 81 include a pair of power contacts 801, four contacts 802 between the pair of power contacts, two pairs of differential pair contacts 803 by opposite outer sides of the pair of power contacts 801, and a pair of grounding contacts 801 respectively located by two opposite outer sides of the two pairs of differential pair contacts 803, respectively. The lower contacts 82 are arranged as well as the upper contacts 81. Each contact 8 includes a contacting section 83 exposed upon the mating surface 1021, and a soldering section 84 extending out of the base 1010. The insulative housing 7 essentially is formed by a first/upper insulator 71, a second/lower insulator 72 and a third/middle insulator 73. The upper contacts 81 are integrally formed with the upper insulator 71 to commonly form an upper/first contact module 91, and the lower contacts 82 are integrally formed with the lower insulator 72 to commonly form a lower/second contact module 92, and the third insulator 73 are applied upon a combination of the upper contact module 91, the lower contact module 92 and the metallic frame 6 (illustrated later) to commonly form the base 1010 and the mating tongue 1020. Notably, the upper contacts 81 do not extend forwardly beyond a front edge of the upper insulator 71, and the lower contact 82 do not extend forwardly beyond a front edge of the lower insulator 72 so as not to interfere with the metallic frame 6 (illustrated later).

The metallic frame 6 is made via metal injection molding or die-casting, and includes a main part 61, a first plate section 62 and a second plate section 63 both extending from the main part 61 forwardly and parallel to each other, and a soldering section 64 extending rearwardly from the main part 61. The upper contact module 91 and the lower contact module 92 are respectively located on two sides of the first plate section 61 in the vertical direction, and the third insulator 73 is applied thereupon to have the both the upper contact 91 an the lower contact module 92 integrally formed with the frame 6 in a fixed manner so as to result in the base 1010 and the mating tongue 1020 accordingly. Notably, the main part 61 of the frame 6 forms opening (not labeled), through which the first/front plate section 62 extends, to allow the upper contact module 91 and the lower contact module 92 to extend therethrough to be positioned upon the opposite upper and lower surfaces of the first plate section 62. The second/rear plate section 63 is located above the upper contact module 92 and coplanar with the upper surface of the step section 1024.

The first plate section 62 includes a thickened front edge 622, and a pair of thickened side edges 621. The thickened front edge 622 is exposed upon the front face 1022 of the mating tongue 1020, and the thickened side edges 621 are exposed upon the side faces 1023 of the mating tongue 1020 to form the corresponding locking sections (not labeled). The thickened front edge 622 and the thickened side edges 621 commonly form a U-shaped receiving structure 625 in a top view so as to receivably confront the upper contact module 91 and the lower contact module 92. Each of the upper contact module 91 and the lower contact module 92 has a pair of protrusions 900 for guidable insertion within the corresponding U-shaped receiving structure 625. An opening 623 is formed in the first plate section 62 to be filled with the third insulator 73. Another opening 624 is formed in the first plate 62 and located behind the front edge 622 to be filled with the third insulator 73 too.

The electronic device 2000 forms a receiving cavity 2002 and a printed circuit board 2001. The main part 61 of the frame 6 is snugly received within the receiving cavity 2002 with the soldering section 62 secured thereto. Notably, the first plate section 62 embedded in the mating tongue 1020 and unitarily formed with the metallic frame 6, inherently owns the relative strong structure compared with the discrete shielding plate in the mating tongue in the traditional connector. In addition, the thickened front edge 622 efficiently protects the front face 1022 of the mating tongue 1020 during insertion for mating between the plug connector and the subject connector 1000, and the thickened side edges 621 efficiently reinforces the locking structure for engagement with the latch of the plug connector (not shown). Notably, the thickened front edge 622 is spaced from the front edge of the upper insulator 71 of the upper contact module 91 and that of the lower insulator 72 of the lower contact 92 with a gap (not labeled) in the front-to-back direction while the third insulator 73 fills such a gap. Understandably, such a gap between the thickened front edge 622 and the front edge of the upper/lower insulator 71/72 communicates with the opening 624 so that the third insulator 73 is joined around the opening 624 and such a gap. It is noted that the thickened front edge 622 extends transversely with a transverse dimension similar to that of the front face 1022 of the mating tongue 1020 and linked with the pair of thickened side edges 622 so as to achieve the superior strength thereof and full protection in a front-to-back direction.

The manufacturing method of making the invention includes the following steps: providing a unitary metallic frame formed by metal injection molding and including a vertical main part and a horizontal front plate section extending from the main part; providing an upper contact module with a plurality of upper contacts integrally formed with an upper insulator via an insert-molding process; providing a lower contact module with a plurality of lower contacts integrally formed with a lower insulator via another insert-molding process; forwardly inserting the upper contact module through a corresponding opening of the main part to position the upper contact module upon an upper surface of the front plate section; forwardly inserting the lower contact module through the corresponding opening of the main part to position the lower contact module upon a lower surface of the front plate section; overmolding a middle insulator upon all the frame, the upper insulator of the upper contact module and the lower insulator of the lower contact to form a mating tongue with a thickened front edge of the front plate section protectively covering/shielding a front face thereof wherein said front face is formed by the middle insulator.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a one piece unitary metallic frame made by metal injection molding and including a vertically extending main part and a horizontally extending front plate section unitarily extending forwardly from the main part in a front-to-back direction and defining opposite upper and lower surfaces in a vertical direction perpendicular to said front-to-back direction;

an opening extending through the main part in the front-to-back direction and communicating with the front plate section;

an upper contact module configured to be forwardly inserted through the opening and positioned upon the upper surface, said upper contact module including a plurality of upper contacts integrally formed within an upper insulator;

a lower contact module configured to be forwardly inserted through the opening and positioned upon the lower surface, said lower contact module including a plurality of lower contacts integrally formed within a lower insulator; and a middle insulator applied upon all the upper contact module, the lower contact module and the frame; wherein said front plate section is unitarily formed with a thickened front edge for confrontation with a plug connector during mating, and a pair of thickened side edges with locking structures thereof for locking the plug connector during mating; wherein said thickened front edge extends continuously along a full width of the front plate section in a transverse direction perpendicular to both the front-to-back direction and the vertical direction.

2. The electrical connector as claimed in claim 1, wherein said upper insulator, said lower insulator and said middle insulator commonly form an insulative housing, said housing includes a base and a mating tongue forwardly extending from the base, and the thickened front edge protectively covers a front face of the mating tongue in the front-to-back direction.

3. The electrical connector as claimed in claim 2, wherein said mating tongue forms a step structure around the base, and said frame further includes a rear plate section spaced from the front plate section in a parallel relation and coplanar with said step structure.

4. The electrical connector as claimed in claim 1, wherein the thickened front face of the frame is spaced from a front edge of the upper insulator and that of the lower insulator with a gap therebetween in the front-to-back direction, and front ends of said upper contacts are terminated around said front edge of the upper insulator, and front ends of said lower contacts are terminated around said front edge of the lower insulator.

5. The electrical connector as claimed in claim 4, wherein the middle insulator is filled within said gap.

6. The electrical connector as claimed in claim 5, wherein the front plate section forms an opening filled by the middle insulator.

7. The electrical connector as claimed in claim 6, wherein said opening is communicatively located behind the thickened front face in a front-to-back direction.

8. The electrical connector as claimed in claim 1, wherein said thickened front edge and said thickened side edge commonly form a U-shaped receiving configuration to protectively receive a front edge region of the upper insulator and that of the lower insulator.

9. The electrical connector as claimed in claim 1, wherein the front plate section forms an opening filled by the middle insulator, and said opening is communicatively located behind the thickened front face in a front-to-back direction.

10. The electrical connector as claimed in claim 1, wherein said thickened front edge extends in a transverse direction perpendicular to both said front-to-back direction and said vertical direction, along a whole front face of a mating tongue of the connector.

11. An electrical connector assembly comprising:

an electronic device forming a receiving cavity and including a printed circuit board around an interior surface;

an electrical connector positioned within the receiving cavity and including:

a one piece unitary metallic frame having a vertical extending main part and a horizontally extending front plate section unitarily extending forwardly from the main part;

an insulative housing applied upon the frame and defining a base and a mating tongue forwardly extending from the base in a front-to-back direction; and a plurality of upper contacts and a plurality of lower a plurality of upper contacts and a plurality of lower contacts retained by the housing and exposed upon two opposite surfaces of the mating tongue; wherein the front plate section forms a thickened front edge protectively shielding a front face of the mating tongue in the front-to-back direction; wherein said thickened front edge extends continuously along a full width of the front plate section in a transverse direction perpendicular to both the front-to-back direction and a vertical direction.

12. The electrical connector assembly as claimed in claim 11, wherein said mating tongue further includes a step structure around the base, and said frame further forms a rear plate section spaced from the front plate section in a vertical direction perpendicular to said front-to-back direction and coplanar with an exterior surface of said step structure.

13. The electrical connector assembly as claimed in claim 11, wherein said upper contacts are integrally formed with an upper insulator to commonly form an upper contact module, and said lower contacts arte integrally formed with a lower insulator to commonly form a lower contact module, and the thickened front edge is spaced from front edges of both said upper insulator and said lower insulator in the front-to-back direction.

14. The electrical connector assembly as claimed in claim 13, wherein said front plate section further includes a pair of thickened side edges liked with the thickened front edge to confine both said upper insulator and said lower insulator in the front-to-back direction.

15. An electrical connector comprising:

a one piece unitary metallic frame made by metal injection molding and including a vertically extending main part and a horizontally extending first plate section unitarily extending forwardly from the main part in a front-to-back direction and defining opposite upper and lower surfaces in a vertical direction perpendicular to said front-to-back direction;

an opening extending through the main part in the front-to-back direction and communicating with the first plate section;

an upper contact module configured to be forwardly inserted through the opening and positioned upon the upper surface, said upper contact module including a plurality of upper contacts integrally formed within an upper insulator;

a lower contact module configured to be forwardly inserted through the opening and positioned upon the lower surface, said lower contact module including a plurality of lower contacts integrally formed within a lower insulator; and a middle insulator applied upon all the upper contact module, the lower contact module and the frame; wherein said frame forms a thickened front edge extending continuously along a full width of the front plate section in a transverse direction perpendicular to both the front-to-back direction and the vertical direction; wherein said frame further includes second plate section extending forwardly from the main part parallel to the first plate section and exposed upon one of said upper contact module and said lower contact module in the vertical direction.

16. The electrical connector as claimed in claim 15, wherein all the first insulator, the second insulator and the third insulator commonly form an insulative housing defining a base and mating tongue extending forwardly from the base in the front-to-back direction, a step is formed around a root of the mating tongue, and said second plate section is exposed upon the step.

17. The electrical connector as claimed in claim 15, wherein said frame further forms a pair of thickened side edges with locking structures thereof for locking the plug connector during mating.

18. The electrical connector as claimed in claim 17, wherein said thickened front edge cooperates with the pair of thickened side edges to form a U-shaped structure thereof.

19. The electrical connector as claimed in claim 18, wherein said first plate section forms an opening in a front region surrounded by said U-shaped structure.

20. The electrical connector as claimed in claim 19, wherein the middle insulator forms, in a front region thereof, another U-shaped configuration surrounded by said U-shaped structure of the frame.

* * * * *